United States Patent [19]

Ishikawa et al.

[11] 4,264,431

[45] Apr. 28, 1981

[54] OIL SAND TREATING SYSTEM

[75] Inventors: Chiwane Ishikawa, Iwaki; Shuichi Sugawara, Tokyo, both of Japan

[73] Assignee: Kureha Kagaku Kogyo Kabushiki Kaisha, Tokyo, Japan

[21] Appl. No.: 47,081

[22] Filed: Jun. 11, 1979

[30] Foreign Application Priority Data

Jun. 27, 1978 [JP] Japan ..... 53-77058

[51] Int. Cl.[3] ..... C10G 1/00

[52] U.S. Cl. ..... 208/11 R; 208/11 LE; 208/130

[58] Field of Search ..... 208/11 R, 11 LE, 130

[56] References Cited

U.S. PATENT DOCUMENTS

| | | | |
|---|---|---|---|
| 3,151,057 | 9/1964 | Schuman et al. | 208/11 R |
| 3,480,540 | 11/1969 | Eng et al. | 208/11 R |
| 3,562,146 | 2/1971 | Deanesly | 208/130 |
| 3,928,170 | 12/1975 | Takahishi et al. | 208/130 |
| 3,956,101 | 5/1976 | Hara et al. | 208/130 |

*Primary Examiner*—Herbert Levine

*Attorney, Agent, or Firm*—Wegner & Bretschneider

[57] ABSTRACT

Residue of distillation, preferably under reduced pressure of oil sand bitumen is thermally treated in a liquid state at a temperature of 350°–450° C. by blowing thereinto an inert heating medium, preferably a superheated steam at a temperature of not lower than the temperature of the residue in a reaction step for 20 to 90 min to crack the residue for converting the residue to a crude synthetic oil, a combustible pitch and a gas, the resultant pitch being utilized to the steps of recovery of oil sand bitumen from oil sand and of distillation as fuel.

4 Claims, 1 Drawing Figure

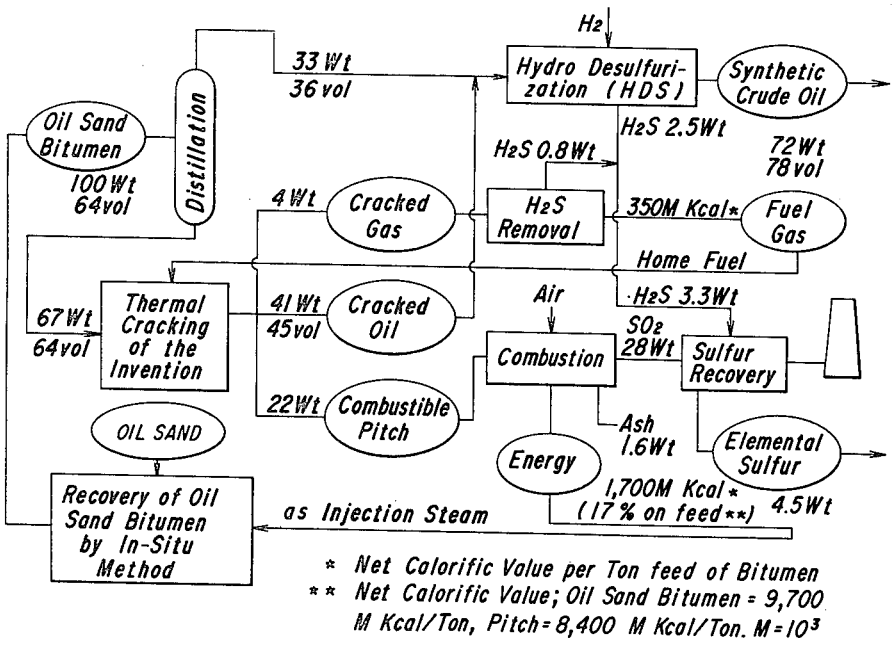

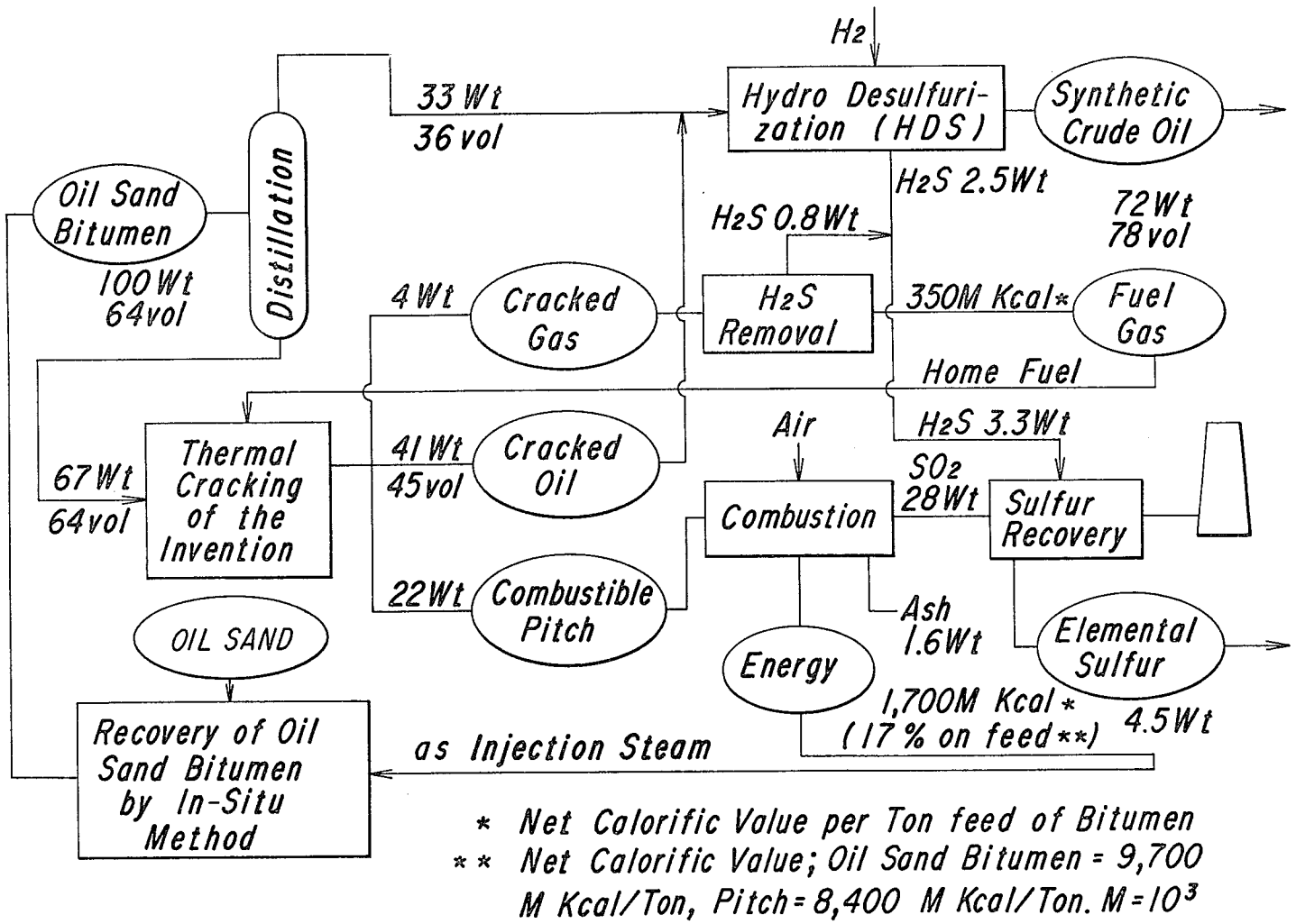
Synthetic Crude Oil
72 Wt
78 vol
Fuel Gas
Elemental Sulfur
4.5 Wt
Sulfur Recovery
Hydro Desulfurization (HDS)
H2
H2S 2.5 Wt
350M Kcal*
Home Fuel
H2S 3.3 Wt
SO2 28 Wt
Ash 1.6 Wt
1,700M Kcal* (17% on feed**)
H2S 0.8 Wt
H2S Removal
Air
Combustion
Energy
Cracked Gas
Cracked Oil
Combustible Pitch
33 Wt
36 vol
4 Wt
41 Wt
45 vol
22 Wt
as Injection Steam
Distillation
Thermal Cracking of the Invention
OIL SAND
Recovery of Oil Sand Bitumen by In-Situ Method
Oil Sand Bitumen
100 Wt
64 vol
67 Wt
64 vol
* Net Calorific Value per Ton feed of Bitumen
** Net Calorific Value; Oil Sand Bitumen = 9,700 M Kcal/Ton, Pitch = 8,400 M Kcal/Ton. M = 10³

OIL SAND TREATING SYSTEM

BACKGROUND OF THE INVENTION

The present invention concerns a novel industrial method of treating oil sand.

Oil sand is a substance attracting notice as the next energy source in place of crude petroleum oil. It is composed of particles 0.05–2.0 mm in diameter of silica sand having their surface covered by a mixture of heavy hydrocarbons called bitumen having a boiling point of higher than 200° C. and specific gravity corresponding to API 8–16. The oil sand containing hydrocarbons more than 10% by weight of itself is said to be profitable from the view point of natural resources.

The economical disadvantages of oil sand consist in a large amount of energy necessary for separating bitumen from silica sand and the difficulty of transportation of the separated bitumen due to its heaviness and viscousness. Especially, considering the environmental situation of the producing district of oil sand, it is very difficult to transport the bitumen for the purpose of rectification. Because the zones of deposition of oil sand situate in the inland area of undeveloped lands where the facilities of energy for development are not sufficient. Also, in order to collect the oil sand bitumen, a method of extraction with hot water of oil sand excavated by open-air mining or a method of collecting bitumen by pumps after fluidizing the oil sand by supplying directly the energy to the deposit of oil sand is adopted, and it is estimated that an amount of energy corresponding to about 20% of the oil sand bitumen calculated as a fuel is necessary for collecting the oil sand bitumen. The collected oil sand-bitumen itself is highly viscous as it is and its high viscosity makes its transportation very difficult.

In prior art, the collected bitumen is at first subjected to a distillation and then the residue of distillation is subjected to the so-called coking procedure to be converted into the distillable products such as naphtha, kerosene, gas oil, etc. and coke. As a typical one, two types of coking procedures are known in the art, they being:

(1) Delayed coking. This proceeds in two stages; the bitumen is rapidly heated in a feed furnace, and then resides for a time in coke drums where the large bitumen molecules are cracked into smaller ones, thus forming distillable products: naphtha, kerosene and gas oil.

(2) Fluid coking. The coker reactor contains fine coke particles in rapid motion in a gas ("fluid" coke) at about 500° C. into which bitumen and steam are fed. The bitumen vaporizes and cracks on contact with the coke and the products are fed to downstream processing. (from T. Williams; Science Affairs, 1976, Vol. 9, No. 3, pages 15–18).

However, not only are these procedures very complicated in their procedures but also the effectiveness of the produced coke as a source of thermal energy is not necessarily high enough.

Accordingly, the main object of the present invention is to make an offer of an economical process of oil sand treating process which supplies a large amount of energy within its process effectively and by which heavy bitumens are converted to oils suitable for transportation.

DETAILED DESCRIPTION OF THE INVENTION

Unexpectedly, according to one aspect of the present invention, it has now been discovered that the residue of distillation obtained by the distillation treatment of the oil sand bitumen which is in itself heavy, the residue of distillation having further polymerized, is very effectively cracked thermally by the introduction of an inert heating medium directly into it at its liquid state and converted into a synthetic crude oil of high quality and a pitch having a high utility as a source of thermal energy.

In the followings, the conditions of actual operation of the present invention are explained in detail.

An oil sand bitumen collected from its deposit is subjected to distillation at ordinary pressure or under reduced pressure to separate an oil fraction. In order to economically carry out the next step of thermal treatment, it is better to use the residue of distillation under reduced pressure as a raw material to be charged because of its quantitatively smaller amount contributing to the reduction of the size of reaction vessel for treating the pitch. Accordingly, it is preferable to distill the oil sand bitumen under reduced pressure as the first step of treatment. Then, the thus obtained residue is introduced into a reaction vessel kept at a temperature of 350° to 450° C., and a non-oxidizing gas at a temperature of 400° to 700°, preferably a superheated steam at a temperature higher than the temperature of the oil in the reaction vessel, is blown into the oil to bring the oil into reaction for 20 to 90 min. The residue is thermally cracked thereby to give an oil as a distillate and a pitch as a residue in the reaction vessel. In cases where the temperature of the reaction is below 350° C., the cracking of the charged residue is incomplete, and in cases where it exceeds 450° C., the coking rapidly proceeds to cause troubles such as clogging of the reaction vessel, and so it is not preferable to have the reaction carried out at a temperature below 350° C. and over 450° C. The duration of the reaction is naturally subject to some fluctuation depending on the temperature of the heating medium and of the charged residue, however, it is preferable to be 30 to 60 min. After the reaction is completed, the pitch is discharged in a liquid state from the reaction vessel while still heating the reaction vessel and then it is sprayed still in a liquid state from a fuel supplying burner of the combustion device into the combustion chamber to be burnt or after cooling it is minutely pulverized and burnt in a pulverized coal boiler. The thermal energy obtained by either combustion device corresponds to 15 to 20% of the calorific value of the raw oil sand bitumen.

In addition, the thermal energy obtained by burning the pitch is recovered as a steam or as electric power and is immediately used for recovering the oil sand bitumen from the oil sand.

Further, the oil fraction obtained by the distillation at normal pressure or under reduced pressure of the oil sand bitumen when combined with the oil which distilled during the reaction of thermal treatment attains an API of 18–22 with a pour point of 4° to 8° C. (lower than that of the raw material by 17°–21° C.) and there is no problem of transportation with the mixture of the oils.

According to the present invention, 60 to 85% by volume of the oil sand bitumen is converted into an oil fraction (synthetic crude oil) and about 20% by weight of the oil sand bitumen is converted to the pitch as the raw material of thermal energy.

EXPLANATION OF THE ANNEXED DRAWING

The annexed drawing is a typical flow diagram of products, sulfur and energy in the oil sand treatment system according to the present invention, and in the drawing, it will be understood that the highly combustible pitch is able to supply almost all the energy necessary for the "in situ recovery process."

In addition, the reaction of thermal treatment of the above-mentioned residue which is the main part of the process of the present invention may be carried out batch-wise in one reaction vessel, however, it is a faborable method to have more than two reaction vessels and to carry out the process continuously by switching depending upon the amount to be treated. Also, the gaseous substances which are produced in several steps of the whole system are utilized as a fuel within the process or a raw material for the energy of collection of the oil sand, and under certain circumstances a part of distilled oil may be used for that purpose.

The synthetic crude oil obtained by the present invention contains smaller amount of impurities as compared to general crude oils because the greater part of heavy metals, asphaltene fractions, sulfurous materials and ashes originally contained in the oil sand bitumen are separated in the process of the present invention and migrate into the pitch, and so the oil shows favorable behaviors worthy of the name of synthetic crude oil, without causing any problem in transportation such as transportation by pipe lines.

EXAMPLE 1

An oil sand bitumen having the properties shown in Table 1 was distilled under reduced pressure to obtain a distilled oil under reduced pressure of which the properties are shown in Table 2 and a residual oil of which the properties are shown in Table 3.

The residual oil obtained by distillation under reduced pressure was introduced into a reaction vessel provided with a stirrer, a heating device and a cooling device for the distillate, in an amount of 10 kg, and it was made to react for a predetermined time period by blowing a superheated steam from a circular stainless pipe 8 mm in internal diameter provided with 10 nozzles 1 mm in diameter and immersed into the oil in the reaction vessel while maintaining the operation conditions shown in the upper part of Table 4.

The material balances of the runs Nos. 1–3 are shown in the lower part of Table 4; and the properties of the distilled oil and the residual pitches are respectively in Tables 5 and 6.

As is seen in Table 4, an amount of the pitch corresponding to 30.8 to 35.0% by weight of the charged oil sand bitumen was separated in a short period of time of 20 to 60 min.

Each of three kinds of the pitch obtained under each set of operation conditions was extremely homogeneous in nature containing no irregularly shaped cokes except spherical solid particles 10 to 50 micron in diameter under a microscope, the particles corresponding to quinoline-insoluble fraction. The net calorific value of the pitch was more than 8,000 Kcal/Kg.

Pitch No. 1 was sprayed at a heated state of a temperature of 350° C. into a combustion chamber of a boiler from a tangential-type burner at an injection pressure of 20 kg/cm$^2$ to be burnt. After finishing the combustion experiment, the formation of coke or the accumulation of coke particles was not observed in the burner to show that the pitch was burnt stably in a liquid state. The thermal energy recovered by the combustion of the pitch calculated from the net calorific value of the oil sand bitumen (shown in Table 1) and the pitch (shown in Table 6), respectively, and the yield of pitch from the oil sand bitumen (22.7% by weight in the case of Pitch No. 1) corresponded to 20.7% of the calorific value of the oil sand bitumen.

TABLE 1

| Properties and State of Oil Sand Bitumen | | | |
|---|---|---|---|
| Specific gravity | (15/4° C.) | 1.0104 | |
| Carbon residue | (% by weight) | 14.9 | (ASTM D189 -65) |
| Sulfur | (% by weight) | 4.59 | |
| Ash | (% by weight) | 0.78 | |
| Elementary analysis (at constant weight, corrected by ash) | | | |
| C (%) | | 83.2 | |
| H (%) | | 10.5 | |
| N (%) | | 0.42 | |
| S (%) | | 4.63 | |
| O (%) | balance | 1.33 | |
| H/C | | 1.51 | |
| Heavy metals | | | |
| Ni (ppm) | | 78 | |
| V (ppm) | | 202 | |
| Viscosity | | | |
| SUS | at 100° F. | 35,100 | |
| | at 210° F. | 513 | |
| Pour point | (°C.) | 25 | |
| Asphaltene | (% by weight) | 16 | |
| Net Calorific value (Kcal/kg) | | 9,720 (including ash)<br>9,800 (corrected by ash) | |

TABLE 2

| Properties of Distillate under Reduced Pressure | |
|---|---|
| Specific Gravity (15/4° C.) | 0.929 |
| API° | 20.7 |
| Distillation Characteristics | |
| Initial boiling point | 140° C. |
| 30% by volume | 320° C. |
| 60% by volume | 380° C. |
| 90% by volume | 443° C. |
| Sulfur (% by weight) | 2.6 |
| Nitrogen (% by weight) | 0.17 |

TABLE 3

| Properties of Residual Oil after Distillation under Reduced Pressure | | |
|---|---|---|
| Specific Gravity | (15/4° C.) | 1.056 |
| Carbon residue | (% by weight) | 22.5 |
| Ash | (% by weight) | 1.29 |
| Elementary analysis | | |
| C (%) | | 83.2 |
| H (%) | | 10.5 |
| N (%) | | 0.42 |
| S (%) | | 4.63 |
| O (%) | balance | 1.33 |
| H/C | | 1.51 |
| (Yield from the oil sand bitumen: 64.2% by weight) | | |

TABLE 4

| Conditions of Operation and Material Balance | Experiment No. | | |
|---|---|---|---|
| Conditions of Operation | 1 | 2 | 3 |
| Temperature of raw oil (°C.) | 390 | 430 | 450 |
| Temperature of steam* (°C.) | 600 | 400 | 400 |
| Amount of steam* (kg/hour) | 0.6 | 1.2 | 1.0 |
| Duration of operation (min) | 60 | 40 | 20 |
| Material balance | | | |
| Gas (% by weight) | 3.0 | 6.2 | 6.7 |

TABLE 4-continued

| Conditions of Operation and Material Balance | | | |
|---|---|---|---|
| | Experiment No. | | |
| Conditions of Operation | 1 | 2 | 3 |
| Distilled oil (% by weight) | 62.0 | 63.0 | 65.2 |
| Separated pitch (% by weight) | 35.0 | 30.8 | 28.1 |
| Separated pitch** (see below) | 22.7 | 17.1 | 15.5 |

Notes
1) steam* : Steam blown into the residual oil after distillation.
2) Separated pitch** : yield vs oil sand bitumen.

TABLE 5

| Properties of Distilled Oil | | |
|---|---|---|
| | Light fraction | Middle-Heavy fraction |
| Specific gravity (15/4° C.) | 0.792 | 0.973 |
| API° | 47 | 14 |
| Distillation characteristics | | |
| Initial boiling point | 85 | 250 |
| 20% by volume | 122 | 379 |
| 40% by volume | 158 | 440 |
| 60% by volume | 191 | 476 |
| 80% by volume | 222 | 510 |
| Sulfur (% by weight) | 2.6 | 4.3 |
| Nitrogen (% by weight) | 0.01 | 0.29 |
| Pour point (°C.) | lower than 0° C. | 7 |

TABLE 6

| Properties and State of Pitch | | | |
|---|---|---|---|
| | 1 | 2 | 3 |
| Softening point (°C.) | 140 | 180 | 207 |
| Volatile matter (% by weight) *1 | 50 | 43 | 40 |
| Quinoline insoluble (% by weight) | 2 | 8 | 12 |
| Elementary analysis | | | |
| C (%) | 82.0 | 82.2 | 82.4 |
| H (%) | 7.5 | 5.6 | 5.2 |
| N (%) | 1.3 | 1.4 | 1.5 |
| S (%) | 5.8 | 6.6 | 6.7 |
| Ash (% by weight) | 3.4 | 3.9 | 4.3 |
| Net calorific value (kcal/kg) | 8,930 | 8,425 | 8,329 |
| Hardgroup Index *2 | 155 | 158 | 170 |
| Viscosity (cst at 350° C.) | 130 | 1,800 | 10,000 |

Notes
*1 : JIS (Japanese Industrial Standard) - M 8812
*2 : JIS - M 8801 - 8 (Corresponding to ASTM D-409-51)

EXAMPLE 2

The pitch shown in Table 6 as No. 2 was sprayed in a manner as in Example 1 into a combustion chamber of a boiler from a tangential-type burner at a temperature of 400° C. at the inlet of the burner under a condition of added steam of a temperature of 300° C. and at a pressure of 25 kg/cm$^2$ (ratio of steam to pitch=1:10) to be burnt. The recovered thermal energy calculated as in Example 1 was 17% of that of oil sand bitumen.

EXAMPLE 3

After cooling the pitch shown in Table 6 as No. 2 below 50° C., it was minutely pulverized in a vertical pressure mill into particles smaller than 0.07 mm in size and supplied into a combustion chamber of a boiler by a rotatory burner to be burnt after mixed with air. Because of its high Hardgroup Index, its pulverizability was high and no fusion and adhesion was observed in the mill. Its combustibility, especially the ignitability in the combustion chamber was highly superior to the minutely pulverized coal, and it was found that the high content of volatile matters in the pitch gave the favorable combustion characteristics.

EXAMPLE 4

The pitch shown in Table 6 as No. 3 was burnt in a manner as in Example 3 in its state of minute particles. The pulverizability of Pitch No. 3 was still better than that of Pitch No. 2, resulting in the reduction of about 30 min of the time required for pulverization. Almost the same combustion characteristics were obtained on this pitch as those obtained in Example 3. The recovered thermal energy calculated as in Example 1 was 15.5% of the calorific value of the oil sand bitumen.

We claim:

1. A process for treatment of oil sand including the steps of recovering a bitumen from said oil sand, distilling said bitumen and thermally cracking the residue obtained by distilling said bitumen comprising, thermally cracking said residue by directly injecting an inert heating medium at a temperature of 400° to 700° C. into said residue in a liquid state for 20 to 90 minutes while maintaining said residue at a temperature within the range of 350° C. to 450° C. during said injection thereby to obtain a crude synthetic oil, cracked gas and a highly combustible pitch, and burning said highly combustible pitch to obtain thermal energy used for recovering said bitumen from said oil sand.

2. The process according to claim 1, wherein said inert heating medium is a superheated steam.

3. The process according to claim 1, wherein said highly combustible pitch is burned in a boiler after being minutely pulverized to generate steam which is used in the step of in situ-recovering said bitumen from said oil sand.

4. The process according to claim 1, wherein said highly combustible pitch is burned in a boiler in a minutely atomized liquid state to generate steam which is used in the step of in situ-recovering said bitumen from said oil sand.

* * * * *